US005848931A

United States Patent [19]

Dortzbach

[11] Patent Number: 5,848,931

[45] Date of Patent: Dec. 15, 1998

[54] CHIMNEY TOP SPARK ARRESTER AND DAMPER

[75] Inventor: Richard A. Dortzbach, 12801 Marsh Creek Rd., Clayton, Calif. 94517

[73] Assignees: Richard A. Dortzbach; Wrenetta R. Dortzbach, both of Clayton, Calif.; Trustees of the Dortzbach Family Trust

[21] Appl. No.: 928,178

[22] Filed: Sep. 12, 1997

[51] Int. Cl.[6] ..... F23L 17/02

[52] U.S. Cl. ..... 454/4; 454/7; 454/29

[58] Field of Search ..... 454/4, 7, 29

[56] References Cited

U.S. PATENT DOCUMENTS 322,832 7/1885 Kittoe ..... 454/29

1,183,804 5/1916 Determann ..... 454/4

4,554,863 11/1985 Dalsin ..... 454/4

*Primary Examiner*—Harold Joyce

*Attorney, Agent, or Firm*—Bruce H. Johnsonbaugh

[57] ABSTRACT

A combination chimney top spark arrester and damper is provided wherein the damper is positioned within the spark arrester. The damper moves between a closed position in which it covers the top of the chimney flue and an open position in which it is raised above the top of the chimney to allow full, unobstructed flow of flue gases. An actuator includes a counterweight urging the damper into its open position. The actuator allows the user to close the damper and to apply a tensioning force to the closed damper to resist vibration and chattering. The device is quickly installed and fits several different chimney sizes.

7 Claims, 5 Drawing Sheets

CHIMNEY TOP SPARK ARRESTER AND DAMPER

BACKGROUND AND BRIEF SUMMARY OF THE INVENTION

This invention relates generally to a combination chimney top spark arrester and damper. More particularly, this invention provides a combined chimney top spark arrester and damper with improved safety, operational and installation aspects over the prior art.

It is known in the prior art to provide a combined chimney top spark arrester and damper. However, most prior art designs utilize a spring loaded damper, and the user pulls against the spring to close the damper. The primary and inherent drawback to such a damper is if the spring fails, the damper either moves from an open to closed position, or remains closed, and smoke damage to persons and property may be the result. It is also known in the prior art to provide a combined chimney top spark arrester and pivoting damper wherein the damper pivot is located a predetermined distance from the damper's center of gravity, effectively providing a counterweight (instead of a spring) to urge the damper toward its open position. However, such prior art provides a damper which is relatively small compared to the chimney top flue opening obstructing approximately 30–35% of the chimney flue area. The present invention obstructs only 8–12% of the chimney flue area. In addition, the pivoting damper requires small clearances between the damper and housing. The reduced size of opening through the damper causes poor draw for the fireplace and possible back-flow of flue gases and smoke into the living space. Small clearances may result in a frozen damper caused by a build-up of soot. A further drawback of that prior art is the damper is cemented in place, requiring the chimney to be swept from below. The present invention is quickly removable from the chimney top, allowing the chimney to be swept from above, which is the preferred method.

The present invention provides a combined chimney top spark arrester and damper which overcomes the inherent weaknesses of prior art designs and additionally provides improvements in safety, operational and installation aspects of the design.

It is a primary object of the present invention to provide a chimney top spark arrester and damper wherein the use of a spring to urge the damper open is avoided.

A further object of the invention is to provide a chimney top spark arrester and damper which utilizes a counterweight to urge the damper open, reducing the risk of personal injury or property damage which may be caused by a damper which closes at an inopportune time or which simply fails to open.

A further object of the invention is to provide a chimney top spark arrester and damper wherein the damper covers the entire chimney top flue opening in its closed position and in its open position, the damper allows full and unobstructed flow of flue gases.

Another object of the invention is to provide a chimney top spark arrester and damper wherein the motion of the damper between open and closed positions avoids tight clearances where damper motion can be slowed or stopped by soot build-up.

Yet another object of the invention is to provide a chimney top spark arrester and damper with improved operational and installation aspects as compared with prior art mechanisms.

Further objects and advantages of the invention will become apparent from the following description of the preferred embodiment and the drawings wherein:

BRIEF DESCRIPTIONS OF THE DRAWINGS

DETAILED DESCRIPTION OF THE DRAWINGS

Figure 1:
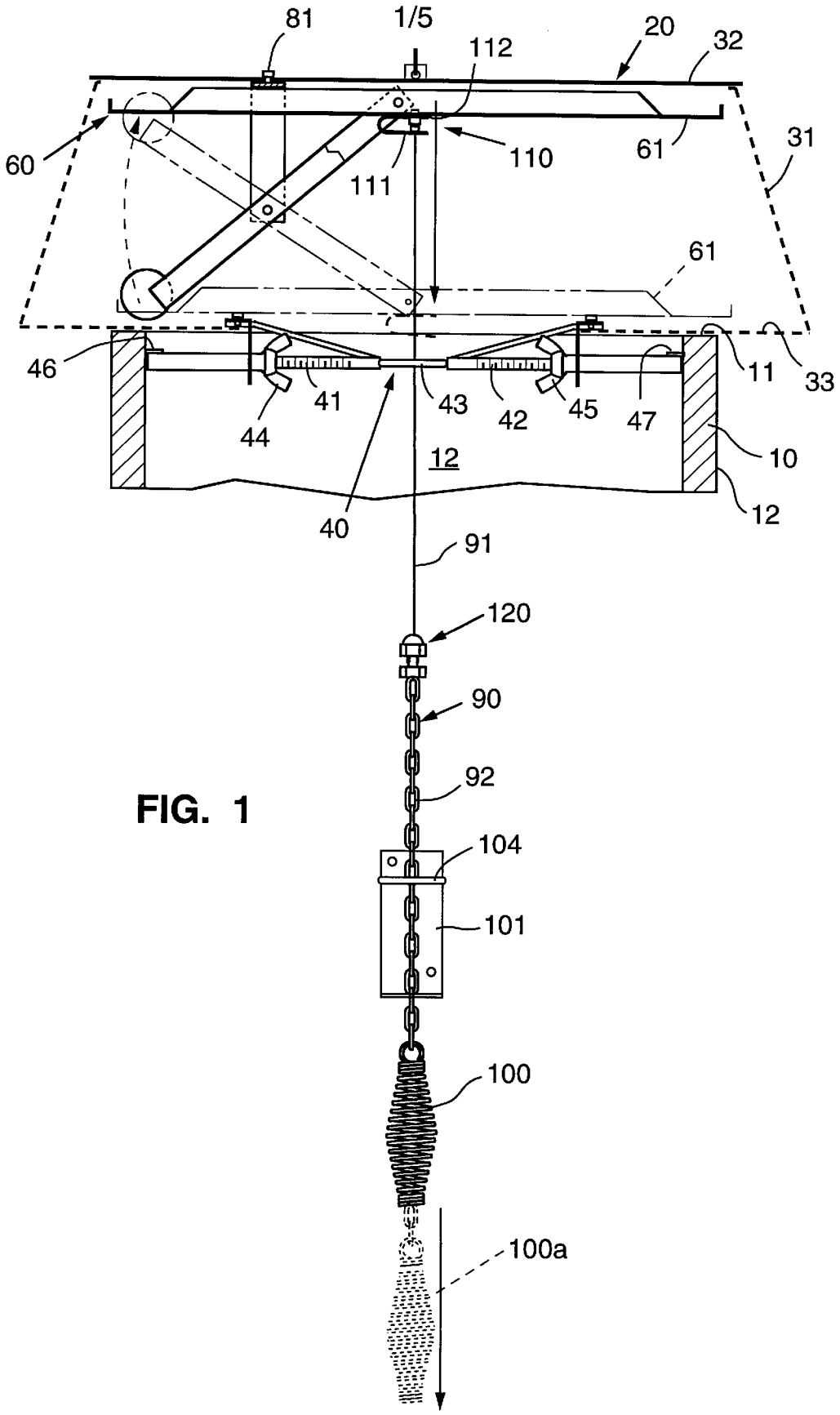
FIG. 1 is an elevational view, partially in section, of the invention.

FIG. 1 shows a typical chimney 10 having a top surface 11 which is usually rectangular. The chimney flue 12 extends downwardly to a firebox (not shown) which contains the handle 100 manipulated by the user.

Figure 2:
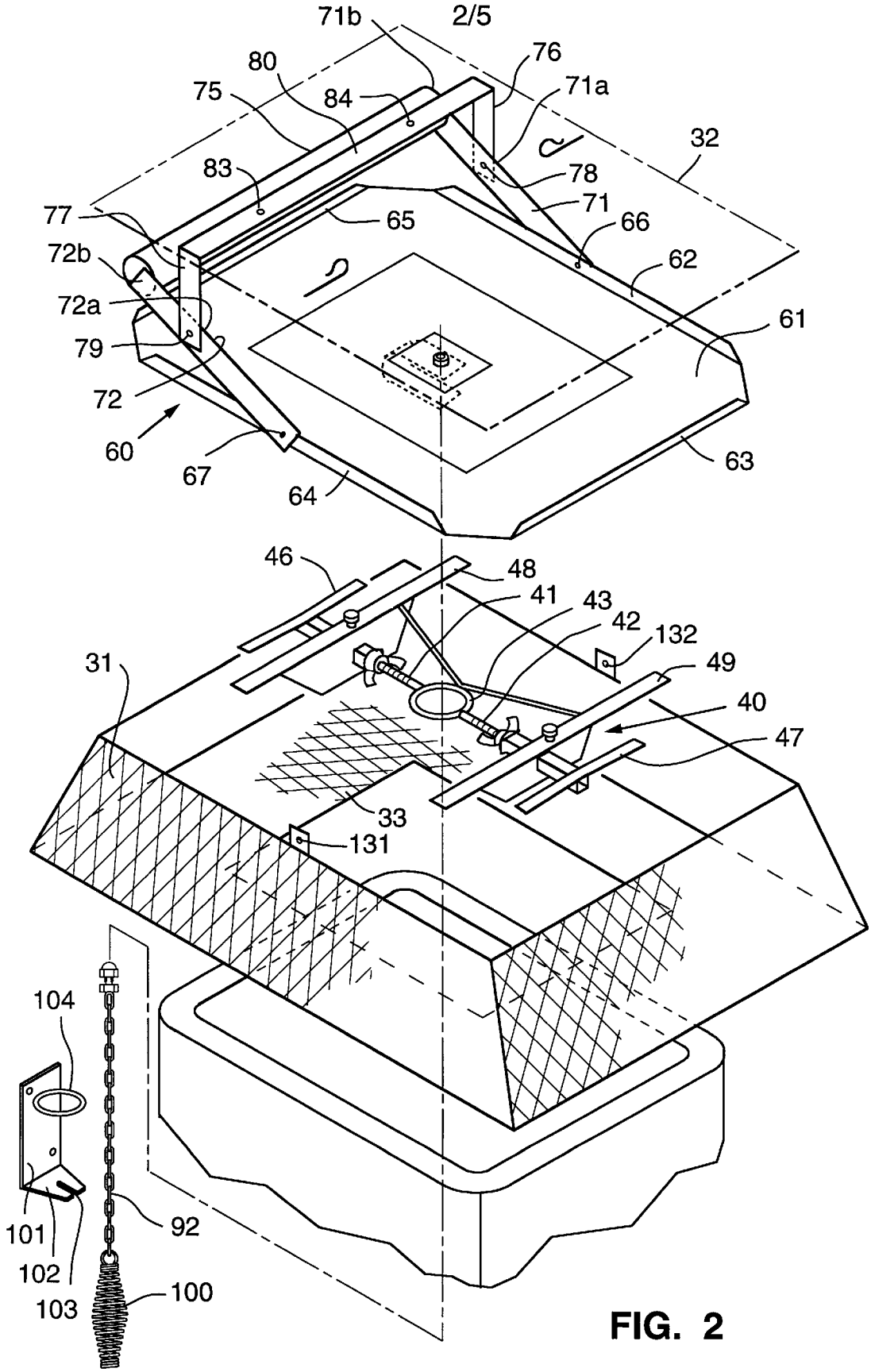
FIG. 2 is an exploded perspective view of the invention.

The combination chimney top spark arrester and damper shown generally as 20 includes a spark arrester hood shown generally as 30, which in the preferred embodiment shown has steel mesh walls 31, steel mesh lower section 33 and a solid cover 32 (FIG. 2). Hood 30 is connected to chimney 10 by attachment means 40 preferably having threaded rods 41 and 42 extending outwardly from a center ring 43. Wing nuts 44 and 45 are carried on rods 41 and 42, and when rotated by hand or with a tool, force mounting bars 46 and 47 against the inner surfaces of chimney 10. Mounting brackets 48 and 49 are also carried by rods 41 and 42 for supporting hood 30.

Damper means 60 (FIGS. 1 and 2) is mounted within hood 30. Damper means 60 is movable between a closed position shown in phantom as 60*a* in FIG. 1 in which damper plate 61 covers chimney top flue opening 12 and an open position shown in solid black as 60 in FIG. 1. In the open position, damper plate 61 is raised upwardly above the top surface 11 of chimney 10 to a horizontal position a sufficient distance from top surface 11 to allow full and unobstructed flow of flue gases through flue opening 12 and damper means 60. In its closed position (shown as 60*a*), damper plate 61 extends horizontally over the chimney top 11 and may be adjusted to provide a predetermined vertical distance from top surface 11 ranging from zero to distances required by local building, safety or fire codes. Some codes now prohibit a tight seal formed by a chimney damper. It is significant that damper plate 61 extends horizontally to or beyond the outer edge 12 of chimney 10, so that damper plate 61 does not pivot or move relative to any vertical interior chimney surface (or damper surface) which may tend to accumulate soot and possibly freeze the motion of the damper.

Damper plate 61 is a flat rectangular plate with upturned edges 62–65. Side edges 62 and 64 are pivotally connected at pins 66 and 67 to parallel pivot arms 71 and 72. Pivot arms 71 and 72 each have mid-sections 71*a* and 72*a*, first ends 71*b* and 72*b* and second ends 71*c* and 72*c*. The first ends 71*b* and 72*b* are connected to and support counterweight 75. Counterweight 75 is preferably cylindrical in shape. Pivot arms 71 and 72 are also pivotally connected to support arms 76 and 77 by pins 78 and 79, respectively. Support arms 76 and 77 are connected rigidly to (or preferably formed integrally with) support bar 80. Support bar 80 carries the weight of the damper and counterweight assembly and the weight is transferred to hood cover 32 (shown in phantom in FIG. 2) by bolts 81 and 82 (82 not visible in the drawings) which thread into holes 83 and 84, respectively.

Figure 7:
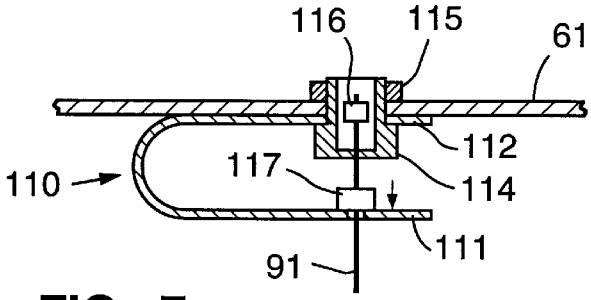
FIG. 7 is a sectional view of a portion of the mechanism when the damper is in its open position.
Figure 8:
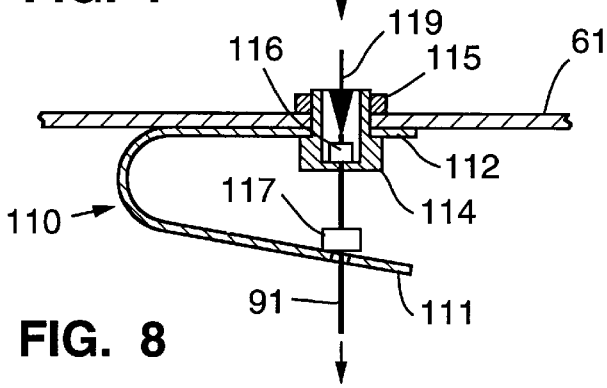
FIG. 8 is a sectional view of the same portion of the invention shown in FIG. 7 when the damper is in its closed position.

Damper means 60 is actuated by a user pulling handle 100. Handle 100 is positioned in the firebox of the chimney in a location allowing the best access to handle 100. By pulling downwardly on handle 100, so that the handle 100 moves to the position shown in phantom in FIG. 1 as 100*a*, the user is raising counterweight 75 while causing damper plate 61 to move downwardly to its closed position. FIG. 1 is obviously not drawn to scale. A pull-cord shown generally as 90 extends from handle 100 upwardly through the chimney flue and connects to the lower end 111 of C-shaped connector means 110. The upper end 112 of connector means 110 is rigidly attached to damper plate 61 by a hollow, threaded bolt 114 and nut 115 (FIGS. 7 and 8). Pull-cord 90 has an upper end or portion 91 that is a smooth metallic cable, such as stainless steel, and a lower end 92 which is a chain. Adjusting means 120 adjusts the overall length of pull-cord 90, as described below, and connects upper and lower ends 91 and 92 together.

Chain 92 cooperates with bracket 101 to hold damper means 60 in its closed position (FIGS. 1 and 2). Bracket 101 is anchored to the firebox (not shown) and has a horizontal ear 102 with a slot 103 formed therein to hold chain 92. Chain 92 extends through, guide ring 104 carried by bracket 101. In order to create a resilient tensioning force in pull-cord 90, the C-shaped connector means 110 is preferably made of spring steel. Additionally, lugs 116 and 117 are securely attached to cable 91 and are positioned so that lug 117 remains in contact with the lower portion 111 of connector means 110 and lug 116 is spaced above the head of bolt 114 when damper means 60 is open. As the user pulls handle 100 downwardly, the damper plate 61 contacts either the chimney top surface 11 or spacers (not shown) placed between surface 11 and plate 61. The user then applies a heavier pulling force, represented by arrow 119, which bends connecting means 110 as shown in FIG. 8. Lug 116 is a safety lug which prevents the user from breaking C-shaped connecting means 110. When an appropriate tensioning force is applied to pull-cord 90, chain 92 is slipped into slot 103, and damper means 60 is held securely in its closed position. The tensioning force resists vibration and chattering of damper plate 61.

Figure 5:
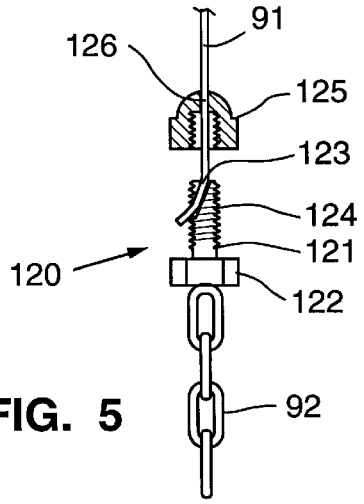
FIG. 5 is an elevational view, partially in section, showing the preferred mechanism for adjusting the length of the pull-cord.
Figure 6:
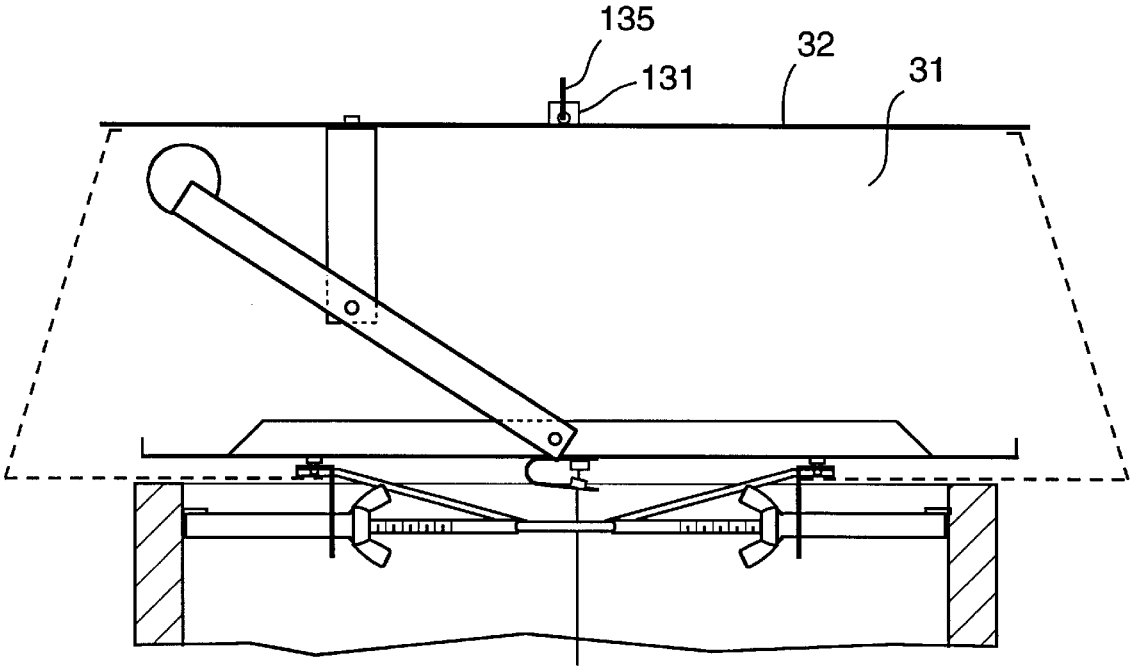
FIG. 6 is an elevational view, partially in section, of a portion of the invention.

Adjusting means 120 provides a quick and effective way to adjust the overall length of pull-cord 90 and to securely connect smooth cable 91 to chain 92. As shown best in FIG. 5, a self-tapping bolt 121 has a head 122 welded to chain 92, and has a tapered groove 123 formed in its threaded end 124 as is commonly known, the groove becoming shallower as it approaches the head 122 of bolt 121. A nut 125 threads onto bolt 121 and in practice is so threaded after pull-cord 90 is set to the proper overall length. As nut 125 is tightened, it frictionally engages the cable 91 in tapered groove 123 and securely holds cable 91 to chain 92. Excess cable is cut off. Nut 125 is shown as an acorn nut with a passageway 126, but an ordinary nut will also suffice. The acorn nut with a passageway is preferred because it centers the cable 91 relative to bolt 121, allowing the cable to hang straight.

Figure 3:
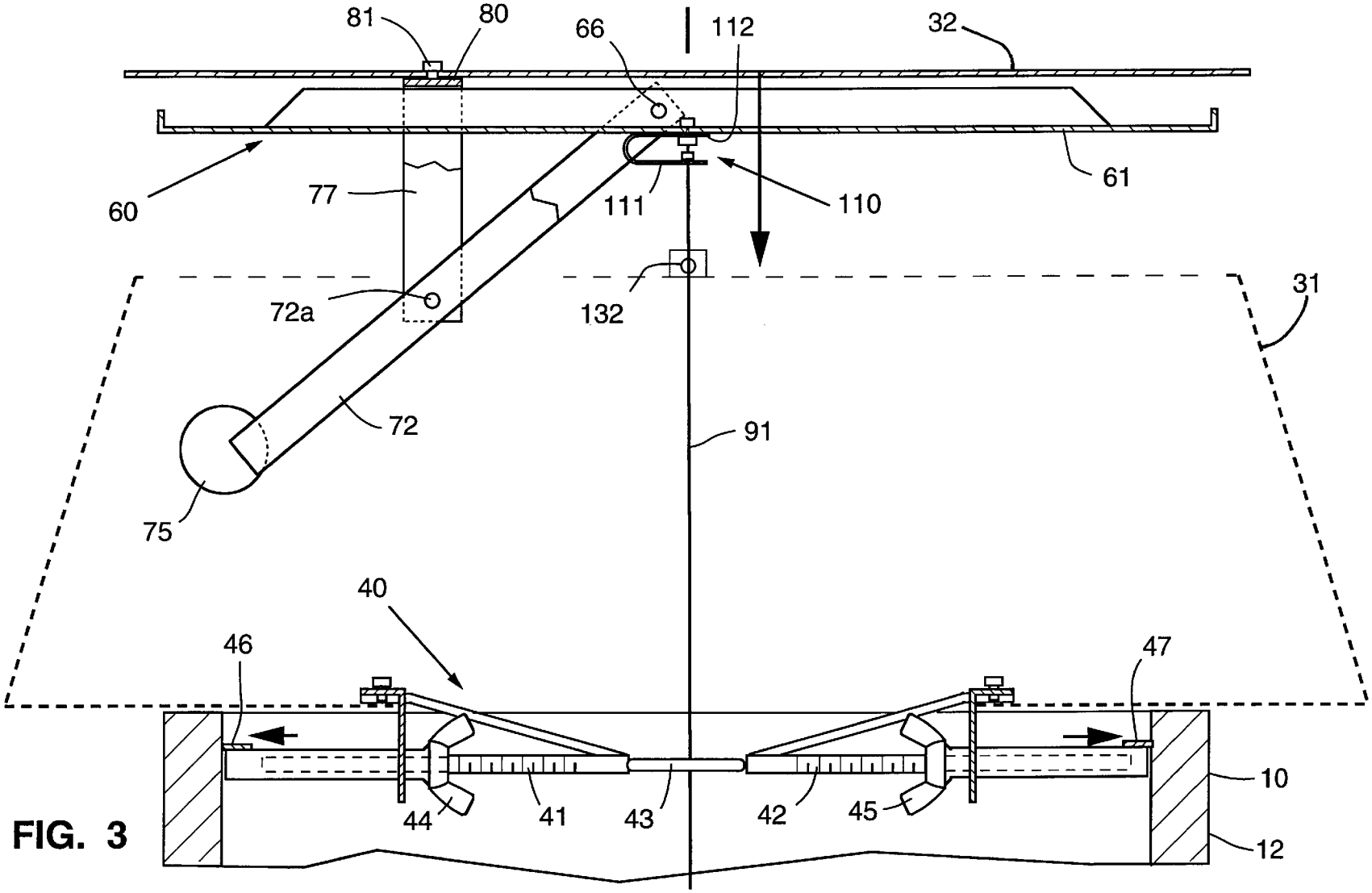
FIG. 3 is an elevational view, in section, of a portion of the invention.
Figure 4:
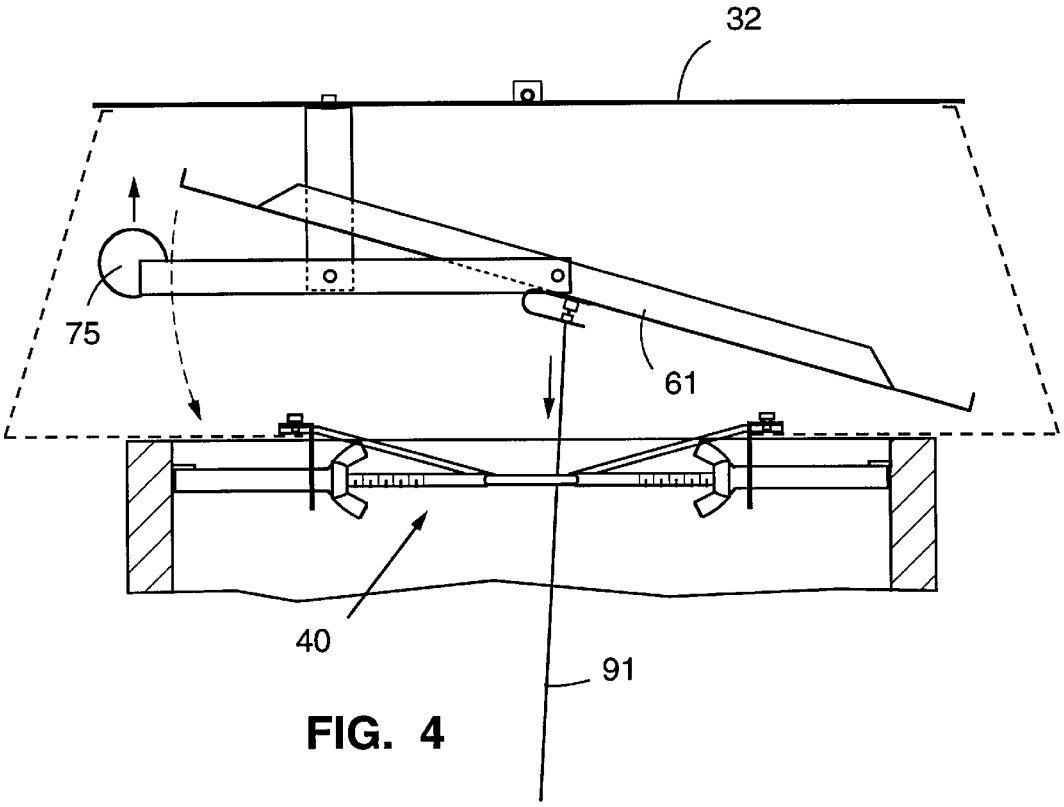
FIG. 4 is a schematic representation of a portion of the invention, showing relative motion of the damper and counterweight.

During installation, the attachment means 40 is installed first, then the steel mesh unit (31 and 33) are installed and connected to attachment means 40. The damper and counterweight assembly are connected to hood cover 32 (FIG. 3) and pull-cord 90 and are installed as a single unit. Hood cover 32 is slotted to pass downwardly over ears 131 and 132 supported by steel mesh walls 31. Cotter pins 135 hold cover 32 securely in place. Installation is speedy, requiring few tools, and a single size fits a wide range of chimney dimensions.

It is to be understood that variations in the design may be made without departing from the spirit of the invention.

What is claimed is:

1. A combination chimney top spark arrester and damper adapted to be mounted on a chimney top flue opening, comprising:

a spark arrester hood, attachment means for connecting said hood to said chimney top, damper means within said hood, said damper means being movable between a closed position in which it covers the top of said chimney flue opening and an open position in which it is raised upwardly above said chimney flue opening a sufficient distance to allow full unobstructed flow of flue gases between said damper and said chimney flue opening, and means for moving said damper between said closed and open positions, said means including a counterweight which tends to hold said damper in its open position, and wherein said counterweight must be raised to move said damper to its closed position.

2. The apparatus of claim 1 further comprising support arms connected to said hood and wherein said means for moving said damper further comprises:

a pair of parallel pivot arms, each arm having mid-sections, first and second ends, said first ends being connected to and carrying said counterweight, said second ends being connected to and carrying said damper, and said pivot arms being pivotally mounted at said mid-sections to said support arms.

3. The apparatus of claim 2 wherein said means for moving said damper further comprises:

a pull-cord having upper and lower ends, said lower end extending downwardly in said chimney flue to be actuated by a user, and connector means attached to said upper end of said pull-cord for resiliently connecting said pull-cord to said damper.

4. The apparatus of claim 3 wherein said connector means comprises a generally C-shaped metallic member, said pull-cord is attached to the lower end of said C-shaped member, and said damper is connected to the upper end of said C-shaped member.

5. The apparatus of claim 4 wherein said pull-cord has upper and lower sections, said upper section being a smooth cable, said lower section being chain, and further comprising means for adjusting the overall length of said pull-cord.

6. The apparatus of claim 5 wherein said means for adjusting the overall length of said pull-cord comprises:

a nut and a self-tapping bolt, said nut being threadable onto said self-tapping bolt, wherein the head of said bolt is rigidly connected to said chain section, wherein said self-tapping bolt has a tapered groove formed in its threaded end, said smooth cable slides through said nut and said groove, such that when the overall desired length of said pull-cord is achieved, said nut is simply tightened on said self-tapping bolt.

7. The apparatus of claim 6 wherein said nut is an acorn nut, said acorn nut has a passageway formed therethrough and said smooth cable extends through said passageway.

* * * * *